United States Patent [19]

Kirkman

[11] Patent Number: 4,526,429

[45] Date of Patent: Jul. 2, 1985

[54] COMPLIANT PIN FOR SOLDERLESS TERMINATION TO A PRINTED WIRING BOARD

[75] Inventor: Michael Kirkman, Barrington, R.I.

[73] Assignee: Augat Inc., Mansfield, Mass.

[21] Appl. No.: 517,510

[22] Filed: Jul. 26, 1983

[51] Int. Cl.[3] ..... H01R 9/09; H01R 13/41; H01R 15/08

[52] U.S. Cl. ..... 339/17 C; 339/217 R; 339/221 R; 339/252 P; 339/276 A

[58] Field of Search ..... 339/252 P, 17 C, 17 R, 339/221 R, 221 M, 220 R, 252 R, 17 D, 183, 217 R, 276 A

[56] References Cited

U.S. PATENT DOCUMENTS

| | | | |
|---|---|---|---|
| 2,917,723 | 12/1959 | Gluck | 339/17 D |
| 3,270,314 | 8/1966 | Kohanek et al. | 339/252 P |
| 3,617,992 | 11/1971 | Ruehlemann et al. | 339/17 L X |
| 3,768,068 | 10/1973 | Palecek | 339/221 M |
| 4,076,356 | 2/1978 | Tamburro | 339/221 R X |
| 4,097,101 | 6/1978 | Holt et al. | 339/17 C |

FOREIGN PATENT DOCUMENTS

| | | | |
|---|---|---|---|
| 246096 | 8/1947 | Switzerland | 339/252 R |

OTHER PUBLICATIONS

Brochure, "Amp-In and Amp Edge Single Lead Printed Circuit Terminals", AMP Incorporated, 1972.

*Primary Examiner*—Gil Weidenfeld
*Assistant Examiner*—Steven C. Bishop
*Attorney, Agent, or Firm*—Weingarten, Schurgin, Gagnebin & Hayes

[57] ABSTRACT

A low insertion force compliant pin is provided for solderless connection to a printed circuit board in which the pin is provided with an enlarged contact portion, a reduced-diameter shank, and one or more slots through the contact portion and the shank such that when the pin is inserted into a solder plated-through hole in the board, the contact portion is compressed on itself, thereby to provide a spring-biased contact to the interior plated wall of the hole in the board. The compliant pin also provides anti-overstress protection by compressing on itself. The compliant pin is adapted for use with a number of different hole sizes, with spring bias tension being controlled by the elasticity of the pin material and the length of the slot or slots and the diameter of the enlarged contact portion. The distal end of the pin is provided with a connector body, a solder lug, a wire wrap pin or other termination device so that the compliant pin forms one part of an electrical interconnection system for connection to the plated-through holes of the board.

11 Claims, 6 Drawing Figures

COMPLIANT PIN FOR SOLDERLESS TERMINATION TO A PRINTED WIRING BOARD

FIELD OF INVENTION

This invention relates to electrical connection systems and more particularly to a pin adapted to a wide variety of hole sizes for plated-through holes in printed circuit boards.

BACKGROUND OF THE INVENTION

As discussed in U.S. Pat. Nos. 4,175,810 and 4,097,101, incorporated herein by reference and assigned to the assignee hereof, electrical interconnection boards, typically referred to as printed circuit, printed wiring or panel boards, normally have mounted thereto a plurality of electronic components such as dual-in-line (DIL) electronic packages which may be integrated circuit packages for other types of electronic components formed with any number of leads. The boards are provided with holes, commonly called "thru holes" or "via holes." The boards are also provided either with printed circuit paths or conductive voltage planes or both. In some prior art devices, leads of electronic components are inserted into plated-through holes, which holes are electrically connected to various printed circuit paths on one or both sides of the board. An electronic device lead is typically then inserted through one of the plated-through holes and is individually soldered or collectively wave soldered so that the hole is filled with solder to permanently mount the component to the board and make positive electrical interconnection with the printed circuit paths.

As discussed in U.S. Pat. No. 4,175,810, it is often desired to employ the concept of plugability, that is, to be able to plug the leads of a component into a board for whatever purposes are desired and then to remove it and plug another component into the board. This, of course, is not possible with the previously discussed method of mounting components to the board because the component leads are soldered thereto. In the past it is known to provide two part socket sleeve assemblies which are mounted in non-plated holes in panel boards wherein one of the sleeves has a lead receiving socket and the other end normally provides a solder tail or wire wrapping pin. See for example, U.S. Pat. No. 3,784,965. The solder tail and wire wrapping pins project for some appreciable distance beyond the component side of the board and the lead receiving socket end of the sleeve normally projects a short distance beyond the other side of the board.

Another commonly used alternative which permits plugability is an insulated socket with contacts mounted thereon. These contacts have extending pins to engage holes in the board and have sockets to receive the lead to the component. The extending pins are normally soldered to the board, such sockets have typically been of DIL configuration, represented by U.S. Pat. No. 3,989,331 and U.S. Pat. No. Des. 210,829.

With respect to the slotted prior art pins which resemble needles having centrally located eyes, such as Feed Thru and Feed to Post Amp Model 117820, not only are these pins not compliant in the sense used herein, they do not contact the entire plated-through hole but rather provide at most two points of contact within the hole.

The aforementioned patents assigned to the assignee hereof are primarily designed to limit the height of the interconnect system vis-a-vis the top surface of the printed circuit board. These connectors include a pin assembly having a fixed or rigid diameter in which the pin is forced into a plated-through hole, with an annular groove being provided circumferentially about the pin into which solder from the plating is squeezed as the pin is inserted into the hole. The proximal end of the pin is slotted such that a lead inserted through a central channel in the pin is gripped by the teeth left by the slotting. The major portion of the pin, and that which contacts the interior solder coated walls, is rigid in both U.S. Pat. Nos. 4,175,810 and 4,097,101, thereby precluding the use of these pins for boards having holes of different diameter. Morever, although the pins are extremely useful for low Z-plane applications, the insertion force is sometimes excessive so that occasionally damage occurs to the plated-through hole. Additionally, when utilizing pins of fixed diameter, tolerances must be held tighter with respect to the hole size and with respect to the thickness of the plating so that the pins can be utilized.

SUMMARY OF THE INVENTION

In contradistinction to the aforementioned pins, the subject pin is compliant throughout the majority of its length in that it is provided with two or more slots which define two or more spring members for the majority of the pin. The pin includes an enlarged contact portion and a reduced-diameter shank with the slots running through the contact portion and partway up the shank. The portion of the shank which is slotted provides for the aforementioned spring members. The length of the slot, the elasticity of the spring members and the size of the enlarged contact portion of the pin control the spring bias tension. When the pin is inserted into a hole, the spring members and contact portion are pressed together, thereby permitting a given sized pin to be accommodated in a wide variety of different size holes. In the subject pin, anti-overstress protection is provided because one portion of the pin is compressed against the opposed portion such that the beams or arms which form the spring members are protected from being permanently bent during mounting. In one embodiment, the enlarged contact portion is cylindrical and is provided with an annular or circumferential groove such that solder at the interior wall of a plated-through hole is squeezed into the annular groove. Even though the pin is compliant so as to be able to accommodate a wide variety of hole sizes, it has been found that even with the lower insertion force provided by the spring members, solder in fact does flow into the groove, thereby increasing the reliability of the electrical connection provided by the pin.

The pin is provided with a superstructure which can be configured in the form of a socket thereby to receive integrated circuit (IC) leads or can be configured in the form of a wire wrap pin or solder tab depending on the application for the pin. In this instance it will be appreciated that for IC leads, the IC lead does not protrude down into the plated-through hole or into or through the pin itself. This gives maximum adaptability of the pin to various size holes since the lateral throw of the spring members is not limited by a pin being inserted therethrough.

In the usual embodiment, the subject pin is made out of beryllium copper or phosphor bronze which is machine-slotted to provide for the hole size adaptability. In one embodiment a single slot is utilized which goes from one side of the round pin to the other, whereas in a second embodiment a splined arrangement is utilized in which orthogonal slots cross along the longitudinal center line of the pin. While in the usual configuration the pins are cylindrical with a pointed nose forming the proximal end, the pin may take on any of a variety of geometric configurations.

As mentioned above, the distal end of the pin includes a shaft having a reduced diameter so that it is the enlarged contact portion of the pin which makes contact with the plated-through holes. The slotted portions of the reduced diameter shaft act as spring arms for moving portions of the proximal end into engagement with the side walls of the holes. If the entire shaft or shank of the pin were made the same diameter as the proximal end, the pin would act as a press fit pin without the required compliance. The reduced diameter distal end provides a relatively long moment arm for the pin thereby reducing insertion force to a fraction of that associated with press fit pins. The moment arm of the pin can be readily adjusted by adjusting the length of the slot in the reduced diameter shaft. This in turn changes the amount of force exerted normal to the longitudinal axis of the pin which is produced by the enlarged contact portion that is in engagement with the side wall of the hole.

The proximal end of the pin is chamfered into a nose, with the nose flared outwardly to a cylindrical contact portion having a predetermined maximum diameter. This contact portion lies to either side of the aforementioned slot and is that which provides the mechanical and electrical contact to the interior wall of the plated-through hole. The proximal end of the pin is tapered to provide easy access to the hole, whereas the pin shaft has a smaller diameter to provide the requisite clearance. In a preferred embodiment the transition between the proximal end and the distal end of the pin is tapered to permit removal of the pin without damage to the plated-through hole.

As described, the subject pin is adaptable for use in circuit boards having holes of varying size. As a result tolerances of the holes in the board may be loosened thereby decreasing the cost of manufacture of both the boards and the pins. The pin is easily inserted and easily withdrawn due to the tapered portions thereof, with the insertion force or withdrawal force being only a fraction of press fit pins.

The subject pin has true compliancy as opposed to those slotted pins the diameters of which are constant throughout the length thereof. Since the moment arm for such prior art pins is relatively short, the pins are relatively stiff. It may be considered that slotted pins having uniform diameters have a zero moment arm with respect to any given portion of the exterior of the pin contacting the interior wall of a plated-through hole. In short, there is no bending of the slotted uniform diameter pins between the end of the slot and the point of contact with the wall of the hole. For this reason alone, this type of pins must be manufactured in a variety of different sizes to accommodate a variety of different sized holes. These pins are also interference fit type pins as are the ones described in the patents assigned to the assignee hereof. All interference fit type pins require high insertion force. Moreover, the slotted pins of the prior art which have uniform diameters when squeezed into a mating hole tend to come out of the hole due to the tapered configuration acquired as the pin is pushed into the connector body.

In summary, the prior art slotted pins of uniform diameter provide a force normal to the insertion direction of, for instance, three to five pounds, whereas the normal force associated with the subject pin is on the order of one half to one and one half pounds. Thus the subject pin has an exceedingly low insertion force.

BRIEF DESCRIPTION OF THE DRAWINGS

These and other features of the subject invention will be better understood in connection with the detailed description taken in conjunction with the drawings of which.

DETAILED DESCRIPTION OF THE INVENTION

Figure 1:
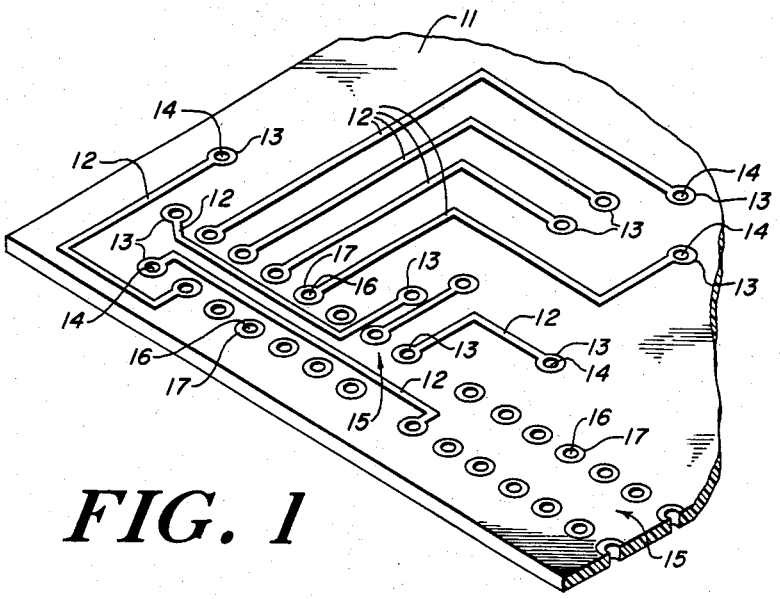
FIG. 1 is a diagrammatic illustration of a portion of a printed wiring board, illustrating plated-through holes and interconnecting busses.

Referring now to FIG. 1, there is shown a portion of a printed wiring board 11 having paths 12 of electrically conductive material on one side thereof, each of the paths terminating in a contact 13 of electrically conductive material surrounding a hole 14. Holes 14 are plated-through having a conductive copper base and a conductive solder coating thereover in a conventional manner. FIG 1 shows several individual plated-through holes 14 at the ends of conductive paths 12 and two dual-in-line arrays 15 of holes 16 having contact pads 17 electrically connected to the plating of respective holes 16.

Figure 2:
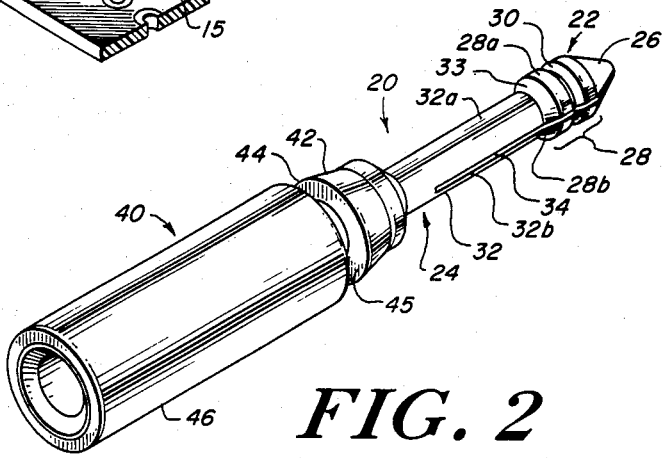
FIG. 2 is an isometric view of the subject interconnect pin for use with the holes of the wiring board of FIG. 1.

Referring now to FIG. 2, a pin 20 suitable for use with holes of differing size is illustrated as having a proximal end 22 and a distal end 24 with the proximal end including a tapered nose 26 and an enlarged cylindrical contact portion 28 which carries a circumferential or annular groove 30. Distal end 24 has a reduced diameter cylindrical shaft 32 with a slot running through a portion of the distal end shaft through the contact portion and through the nose of the pin. It is this pin which is adapted to be inserted into the plated-through holes of a printed circuit board in such a manner that the side walls of the plated-through holes make contact with the enlarged contact portion of the pin.

The transition between the reduced diameter shaft and the enlarged contact portion 28 is tapered as illustrated at 33 to permit withdrawal of the pin from the associated hole, whereas the tapered nose 26 of the pin permits easy insertion of the pin into the hole. Note that the flow of solder into groove 30 as will be described in connection with FIG. 3 does not form an insurmountable impediment to the removal of the pin should such be desired.

In operation, slot 34 permits the springing together of the separated enlarged contact portions 28*a* and 28*b*, with the separated portions being cammed inwardly by the interior wall of the associated hole. Shaft portions 32*a* and 32*b* to either side of slot 34 act as spring members to urge the enlarged contact portions into engagement with the plated through interior wall of the hole. The spring moment produced by arms 32*a* and 32*b* is a function of the elasticity of the material, and more importantly, the length of slot 34 in shaft 32. In one embodiment, the force provided by the enlarged contact portion of the pin normal to the wall of the holes is adjusted to be on the order of three quarters of a pound to one and one half pounds, a significant reduction over that associated with other types of pins inserted into printed circuit boards. It will be appreciated that were the shaft diameter to be equal to the diameter of the contact portion of the pin, then the spring moment could not easily be adjusted since the lever arm or moment arm thereof would essentially be zero for each location along the longitudinal axis of the pin.

As illustrated in FIG. 2, distal end 24 of pin 20 is provided with a connector generally indicated at 40. The connector is mounted to a tapered base 42 at the end of shaft 32, in which the base has a shoulder 44 at the junction of a flat top surface 45. Surface 45 may be used as a contact pad, solder lug or welding pad. Connector 40 has a barrel 46 mounted to the top surface of the base, with the barrel containing contacts (not shown in this figure) adapted to receive an IC lead. As will be discussed in connection with FIG. 6 the termination of the pin may include a wire wrap pin or a solder or welding pad depending on the application for the pin.

Figure 3:
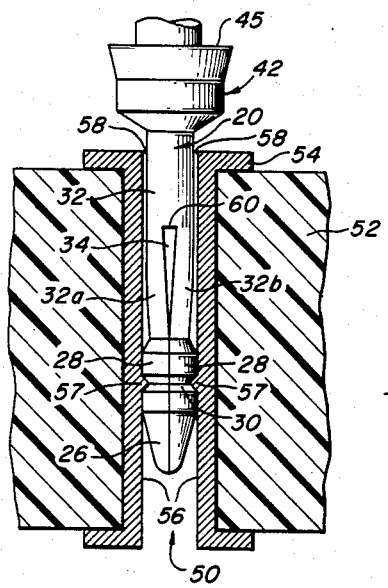
FIG. 3 is a cross sectional and diagrammatic view of the insertion of the pin of FIG. 2 into a plated-through hole of the type illustrated in FIG. 1.

Referring to FIG. 3, pin 20 is shown inserted into a hole, aperture or channel 50 in a printed circuit board 52 which is provided with a solder-coated plating layer 54 as illustrated. In this diagram nose 26 is cammed closed by virtue of the cooperation of the outer diameter of the enlarged contact portion 28 as it is cammed inwardly by the interior wall 56 of plating layer 54. As the pin is inserted, spring members 32*a* and 32*b* have their ends urged inwardly thereby providing a spring moment to the contact portion of the pin.

In has been found that between three quarters of a pound and 1.5 pounds of outwardly-directed force is sufficient to create good electrical contact with plating layer 54 and that plating layer 54 flows into groove 30 as illustrated at 57.

The clearance illustrated at 58 between shaft 32 and interior wall 56, at least from the top 60 of slot 34 towards the proximal end of the pin permits the full lever arm spring moment to be applied to the contact portion 28 of the pin, whereby the spring constant of the pin can be made relatively low so that the insertion force of the pin can be made low.

Figure 4:
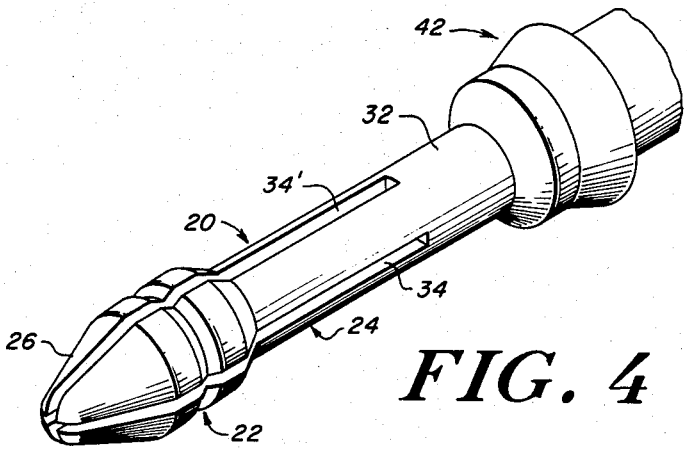
FIG. 4 illustrates a splined double-slotted embodiment of the subject pin.

Referring now to FIG. 4, an orthogonal slot 34' may be provided in pin 20 thereby to provide a splined action for the pin. It will be noted that both slots 34 and 34' run through shaft 32 and through nose 26.

Figure 5:
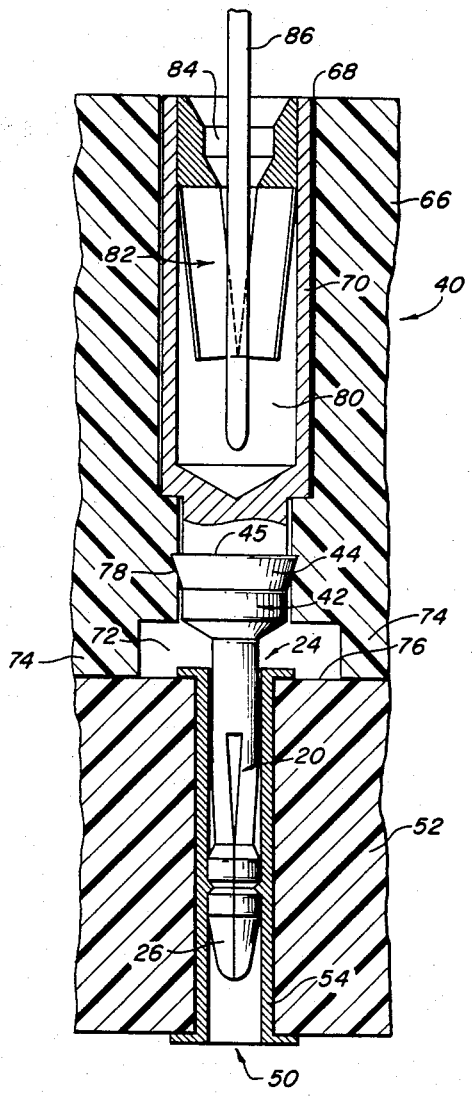
FIG. 5 is a cross sectional and diagrammatic view of the subject pin provided with a connector at the distal end thereof.

Referring now to FIG. 5, the distal end 24 of connector 20 may be provided with connector 40 of FIG. 2 by providing a housing 66 having an interior channel 68 into which the pin-connector combination is inserted from the top. Housing 66 forms part of aformentioned barrel 46 of FIG. 2. An electrically conductive connector housing 70 is attached to base 42 with the housing, base and pin being inserted into channel 68. As illustrated, the pin and a portion of base 42 extend through a lower expanded aperture 72 in housing 66. This expanded aperture provides for standoff portions 74 of housing 66 such that base 42 is positioned a predetermined distance from top surface 76 of printed circuit board 52. The tapered outwardly flanged shoulder 44 comes to rest at 78 where it is captured in housing 66, with housing 66 being made sufficiently elastic for this purpose. Connector housing 70 has an interior channel 80 into which a four pronged connector generally indicated at 82 is inserted from the top thereof. Connector 82 has an aperture which is chamfered as illustrated at 84 to guide and permit the insertion therethrough of a lead 86 from an integrated circuit (not shown).

Figure 6:
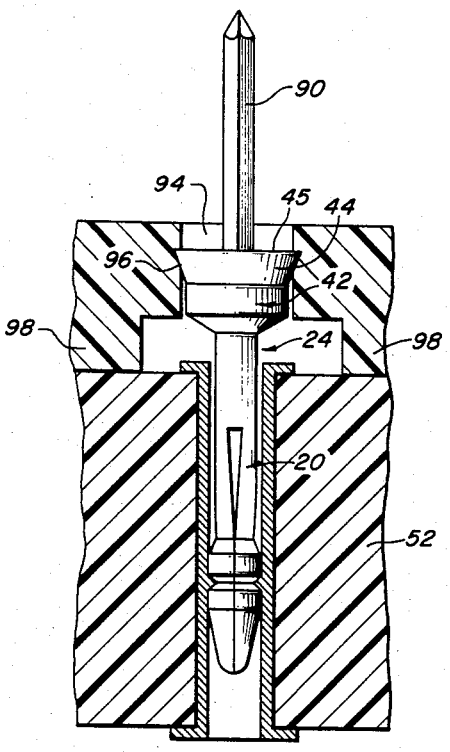
FIG. 6 is a cross sectional and diagrammatic view of the subject pin provided with a wire wrap pin at the distal end thereof.

In the alternative, as illustrated in FIG. 6, distal end 24 of pin 20 may be provided with a wire wrap pin 90 secured to shoulder 44 at top surface 45. In this embodiment, shoulder 44 is located in a housing 92 having a central channel 94, the housing being sufficiently elastic to accommodate shoulder 44. Again portions 98 provide a standoff with respect to base 42.

Having above indicated a preferred embodiment of the present invention, it will occur to those skilled in the art that modifications and alternatives can be practiced within the spirit of the invention. It is accordingly intended to define the scope of the invention only as indicated in the following claims.

What is claimed is:

1. A low insertion force electrical interconnection resilient pin adapted for use with plated through-holes of varying size in a printed wiring board to provide good electrical connection between the leads of externally mounted components or wires and the printed wiring board holes comprising:

a pin having an enlarged diameter proximal end and a reduced diameter distal end, said enlarged diameter proximal end including a tapered nose having an annular groove therein, said distal end having a shaft and means at the end of said shaft for making electrical contact to said leads or wire;

a portion of said shaft, said contact portion and said nose having a slot therethrough running from one side of said pin to the other for a length which includes said annular groove for dividing said shaft portion, said annular groove and said nose into two spaced apart portions, said slot thereby providing two spaced apart spring members, the spring moment applied to said spring members being sufficient to provide metal flow into said annular groove upon insertion of said resilient pin into a plated printed wiring board through-hole.

2. The pin of claim 1 and further including a tapered transition portion between said contact portion and said shaft.

3. The pin of claim 1 wherein said pin material is beryllium copper.

4. The pin of claim 1 wherein said pin material is phosphor bronze.

5. The pin of claim 1 wherein said spring moment is such that the outwardly directed force applied by said contact portions is between three quarters of a pound and one and one half pounds.

6. The pin of claim 1 wherein said electricl contact making means include a base at the end of said shaft, said base having an outwardly and upwardly tapered portion and a flat top surface defining a shoulder thereof at the edge of the top surface.

7. The pin of claim 6 and further including an electrical connector mounted to said flat top surface.

8. The pin of claim 6 and further including a wire wrap pin extending from said flat top surface.

9. The pin of claim 6 wherein said flat top surface includes a contact pad for soldering or welding.

10. The pin of claim 6 and further including a housing having a channel therethrough and an enlarged aperture communicating with said channel at one surface of said housing, said pin and base being pushed through said channel such that said pin extends from said enlarged aperture and such that the shoulder of said base is captured in the channel of said housing.

11. The pin of claim 1 wherein said contact portion is cylindrical.

* * * * *